US005140318A

United States Patent [19]

Stiner

[11] Patent Number: 5,140,318

[45] Date of Patent: Aug. 18, 1992

[54] DATA TRANSMISSION SYSTEM FOR DOWNHOLE LOGGING TOOLS

[75] Inventor: Truman R. Stiner, Blackwell, Okla.

[73] Assignee: Conoco Inc., Ponca City, Okla.

[21] Appl. No.: 684,639

[22] Filed: Apr. 12, 1991

[51] Int. Cl.[5] ..... G01V 1/00

[52] U.S. Cl. ..... 340/854.8; 340/854.9; 340/855.1; 73/151; 166/66; 175/40

[58] Field of Search ..... 73/151; 367/77; 340/854, 855, 854.8, 854.9, 855.1; 166/66, 250; 175/40

[56] References Cited

U.S. PATENT DOCUMENTS

| | | | |
|---|---|---|---|
| 2,505,144 | 4/1950 | Rutherford | 177/336 |
| 3,916,685 | 11/1975 | Paap et al. | 73/152 |
| 4,017,845 | 4/1977 | Kilian et al. | 333/1 |
| 4,136,327 | 1/1979 | Flanders et al. | 340/18 FM |
| 4,156,869 | 5/1979 | Schukantz | 174/108 |
| 4,302,757 | 11/1981 | Still | 340/854 |
| 4,893,496 | 1/1990 | Bau et al. | 73/151 |

*Primary Examiner*—J. Woodrow Eldred

[57] ABSTRACT

A data transmission system for use with such as the seven conductor logging cable that functions to provide more precise transmission of data signal with reduced interference from higher powered electrical signals present along the line. The data signals are modulated on a radio frequency carrier which is then inductively coupled to the cable jacket or shielding sheath for conduction along the cable. Thus, as the logging cable supports a downhole tool in a borehole, transmitter/-receiver combinations both downhole and at the surface can communicate via modulated RF signal conducted along the standard shielding material of the cable. A primary advantage to this type of transmission is the fact that no signal must reverberate through the cable reel as it can be inductively picked off prior to the cable entering the reel section, resulting in much reduced attenuation and interference.

7 Claims, 1 Drawing Sheet

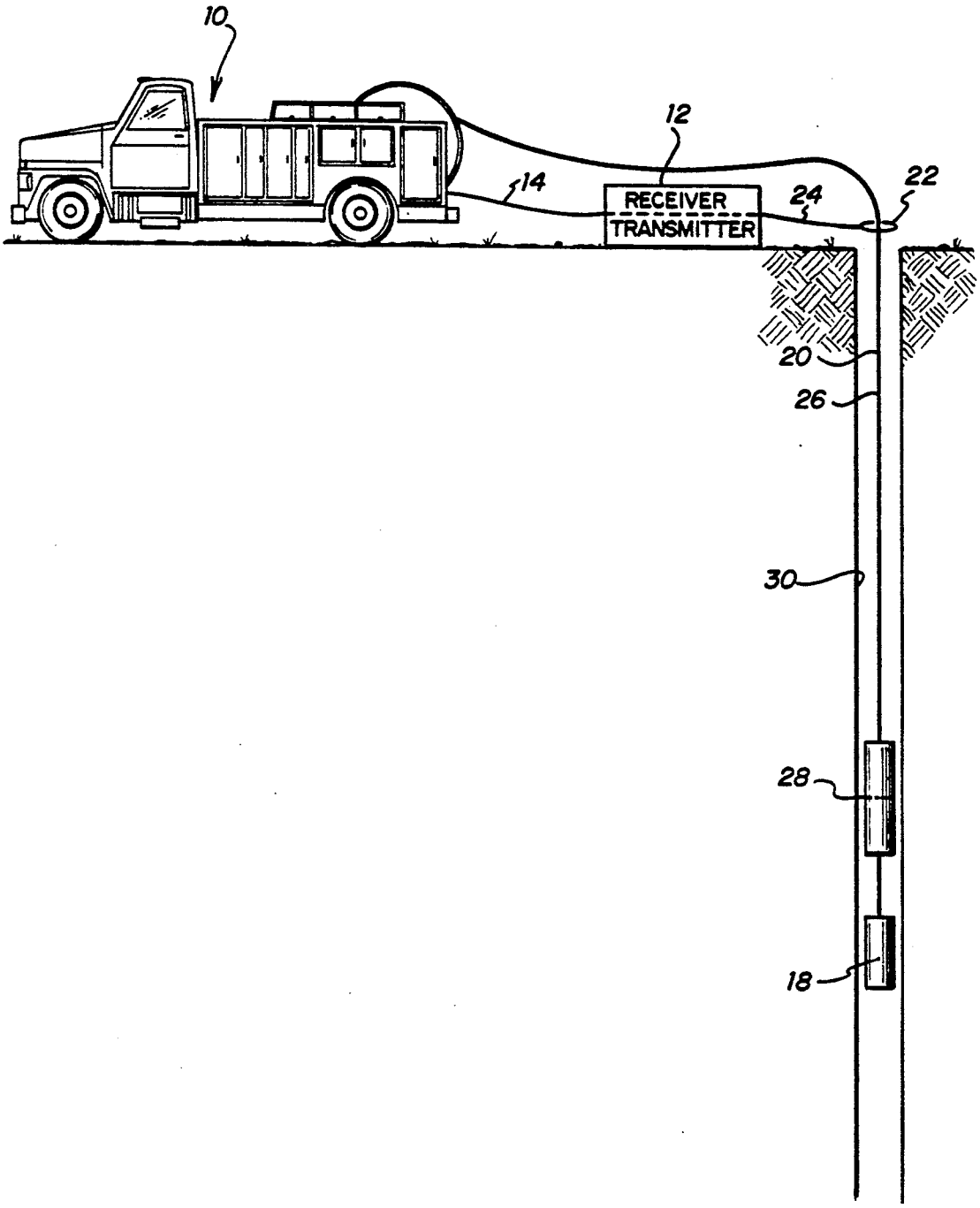
10
12
14
RECEIVER
TRANSMITTER
24
22
20
26
30
28
18

DATA TRANSMISSION SYSTEM FOR DOWNHOLE LOGGING TOOLS

BACKGROUND OF THE INVENTION

1. Field of the Invention

The present invention pertains to data transmission systems and more particularly to transmission systems that are used between surface data acquisition systems and downhole data gathering systems that compensate for standing wave nodes.

2. Related Prior Art

Prior art transmission systems between surface data acquisition systems and downhole data gathering equipment are fairly common in the oil industry. Most transmission systems are "hard wired" or require actual physical connections between the surface and the downhole equipment. Examples of relevant prior art systems are as described below.

U.S. Pat. No. 2,505,144, "Signaling System for Use in Mine Shafts", (Rutherford), relates to a system used to provide an signaling system for use in mine shafts as a means of communication between the hoist operator on the cage, or skip, during the movement of the cage. This system uses the hoisting cable as an autotransformer and is operative irrespective of its position, or depth, in the shaft, or conditions which may cause variations in the capacitance between the cage walls of the shaft.

U.S. Pat. No. 4,136,327, "Well Survey System Modulation Technique", (Flanders, et al.), relates to a communication system that uses a single pair of conductors in which a drill cable in a borehole is used not only to transmit power into the hole, and to communicate sensor data back up to the surface. A frequency for power and communication of 1 kHz is employed. However, this is frequency modulated by deviation of about five percent to transmit commands down hole. A different non-interfering phase modulation is used to send data back to the surface by causing a susceptance (preferably capacitive) to be connected across the supply cable to signify a binary pulse. The alternation in phase between current into the cable and potential across it is observed at the surface and the pulses so detected are processed by conventional data processing techniques. A coding method is used for sending commands into the hole. Each of a series of possible commands is assigned a binary value so that, for example, if commands two and four are to be sent, a total of two plus eight pulses (all of equal weight) forming a command word are sent down hole where they are counted by a binary counter. When the total number has been counted, outputs two and four of the counter will have signals on them which constitute the transmitted orders.

U.S. Pat. No. 4,017,845, "Circuitry for Simultaneous Transmission of Signals and Power", (Kilian, et al.), relates to a transmission line having a pair of wires enclosed in a shield which is used to simultaneously transmit high frequency signals and low frequency power between distant locations. At the sending end of the line a high frequency source is connected between the first and second wires by circuitry which prevents the low frequency power from being coupled into the high frequency source. A low frequency power supply is connected between the shield and both of the wires by circuitry which prevents the high frequency signals from being coupled into the low frequency supply. At the receiving end of the transmission line circuitry is provided which separates the high frequency signals from the low frequency power.

U.S. Pat. No. 4,156,869, "Conducting Cable", (Schukantz), relates to a cable for conveying information signals of selected frequencies and for simultaneously conveying a selected amount of electric power, in which a central conducting means is surrounded by a dielectric material. An outer conducting means is positioned around the dielectric, and cooperates with the central conducting means to provide a first path, through which the information signals are conveyed. One of the conducting means provides a second path, through which the electric power is conveyed.

U.S. Pat. No. 3,916,685, "Well Logging System and Method Using an Armored Coaxial Cable and Compensation Circuit", (Paap, et al.), relates to a well logging system which includes a transmitter in a borehole, having a sensor such as a radiation detector, a condition relating to the earth's formation traversed by the borehole. The transmitter provides data pulses which correspond in number and peak amplitude to the sensed condition. The transmitter also includes a reference pulse source and means for combining the reference pulses and the data pulses. The combined pulses are conducted to a receiver at the surface by an inner conductor of an armored coaxial cable. The shield of the armored coaxial cable is insulated from the inner conductor and from an outer cable armor which surrounds it. The shield provides a return path for the combined pulses thereby reducing the skin effect encountered when using the outer armor as a return path. High voltage for energizing the sensor is also conducted to the sensor by the inner conductor of the armored coaxial cable from a direct current power supply on the source. Low voltage is conducted by the shield of the armored coaxial cable from the power supply to the sensor, to the reference pulse source and to the combining means, while the outer armor of the armored coaxial cable provides a common ground connection between the transmitter, the power supply, and the receiver. The receiver includes a compensating circuit which monitors the reference pulses and adjusts the data pulses in accordance with the monitored reference pulses to compensate for deterioration of the data pulses during their transmission. The receiver also includes recording means which provides a record of the sensed nature of the earth formation in accordance with the compensated data pulses.

SUMMARY OF THE INVENTION

The frequencies listed in the foregoing prior art patents are from 100 kHz to as high as 20 MHz and contain no teachings to compensate for standing wave nodes. The present invention provides a data transmission system for use with a standard seven conductor logging cable that functions to provide more precise transmission of data signal with reduced interference from higher powered electrical signals present along the line. The data signals are modulated on a radio frequency carrier which is then inductively coupled to the cable jacket or shielding sheath of the logging cable for conduction along the cable. Thus, as the logging cable supports a downhole tool in a borehole, transmitter/-receiver combinations both downhole and at the surface can communicate via modulated RF signal conducted along the standard shielding material of the cable. A primary advantage to this type of transmission is the fact that no signal must reverberate through the cable reel as it can be inductively picked off prior to the cable entering the reel section, resulting in much reduced attenuation and interference.

BRIEF DESCRIPTION OF THE DRAWINGS

The attached FIGURE is a schematic drawing illustrating a downhole tool connected to a surface data acquisition vehicle.

DESCRIPTION OF THE PREFERRED EMBODIMENT

The present invention provides a method and apparatus for data transmission between a downhole tool and a data acquisition system that is located on the surface. The data transmission system of the present invention is designed for use with a cable such as a seven conductor logging cable. In this manner the cable system functions to provide more precise transmission of data signals with reduced interference from higher powered electrical signals present along the line.

Referring now to the attached FIGURE, the present invention is illustrated in schematic form. A logging truck 10 is connected to transmitter/receiver 12 via hard wire connection 14. Logging truck 10 is also connected to downhole tool 18 through logging cable 20. Transmitter/receiver 12 is inductively coupled to logging cable 20 through a pickup loop 22 via a hard wire connection 24. Logging cable 20 preferably includes a conductive sheathing such as cable jacket 26, so that electromagnetic signals, such as radio frequency waves, can be easily transmitted along its periphery.

Located in close proximity to downhole tool 18 is a second transmitter/receiver 28, which is also inductively coupled to logging cable 20.

In operation, the data signals are modulated by transmitter/receiver 12 on a radio frequency carrier which is then inductively coupled to cable jacket or shielding sheath 26 of logging cable 20 for conduction along logging cable 20. Thus, as logging cable 20 supports downhole tool 18 in a borehole 30, downhole transmitter/receiver combination 28 and surface transmitter/receiver 12 can communicate via a modulated radio frequency (RF) signal conducted along standard cable jacket 26 of logging cable 20. A primary advantage to this type of transmission is the fact that no signal must reverberate through the cable reel as it can be inductively picked off prior to the cable entering the reel section, resulting in much reduced attenuation and interference.

The purpose of this data transmission system is to increase the amount of data that can be sent between downhole logging tool 18 and logging truck 10 in real time using a standard seven conductor logging cable 20. A standard jacketed logging cable is described for convenience but any cable having conductive material, such as a wench cable may be substituted. However, an insulated cable provides better isolation from the well casing.

This can be done by coupling a modulated radio frequency signal to and from cable jacket 20 as illustrated in FIG. 1. Using pickup loop 22 to couple signals onto cable 20 at logging truck 10, data signals will not be attenuated by the full length of cable 20 on truck 10. Also, no slip rings are required for contact at the cable drum (not shown).

Noisy power signals on the inside conductors will not affect the transmitted data signals because of the shielding effect of outside cable jacket 26 and the higher frequency of the transmitted data signal. Logging cable 20 in conjunction with borehole 30 would act much like a lossy coaxial transmission line. This is more evident if borehole 30 is cased, has a steel pipe lining.

By driving radio frequencies in the preferred range of 100 MHz to 150 MHz, very high data rates could be sent up and down hole. However, it is to be appreciated that the range of 100 MHz to 150 MHz is only a preferred range and other suitable frequencies may used. Multiple modulating frequencies could be applied to the carrier at the same time. Boreholes can be 25,000 ft. or more. The position of logging tool 18 in borehole 30 will always be changing during logging. This will cause the signals to have standing wave nodes where signals are weak. If, at a predetermined signal level, the frequency were shifted to move the node to a higher signal level, data would not be lost. In other words, if the data signal falls below a predetermined minimum, the frequency on which the data signals are modulated is shifted.

While there has been illustrated and described a particular embodiment of the present invention, it will be appreciated that numerous changes and modifications will occur to those skilled in the art, and it is intended in the appended claims to cover all those changes and modifications which fall within the true spirit and scope of the present invention.

What I claim is:

1. A data transmission system for use with a multiple conductor logging cable on a cable reel connecting a downhole tool to a logging truck comprising:

cable jacket around the multiple conductor logging cable;

means for producing data signals from the logging truck;

means for modulating said data signals on a radio frequency carrier wave;

means for inductively coupling said modulated data signals to said cable jacket for conduction along the cable, said means for inductively coupling connected between the cable reel and the downhole tool; and means for receiving said modulated data signals.

2. The data transmission system according to claim 1 wherein said means for modulating data signals includes:

second means for modulating data signals on a second radio frequency carrier wave.

3. The data transmission system according to claim 1 also including:

means for determining signal level;

means for shifting frequency on which said data signals are modulated whenever said signal level is lower than a predetermined maximum.

4. A method for data transmission for use with a multiple conductor logging cable on a cable reel connecting a downhole tool to a logging truck comprising:

providing a cable jacket around the multiple conductor logging cable;

producing data signals from the logging truck;

modulating said data signals on a radio frequency carrier wave;

inductively coupling said modulated data signals to said cable jacket for conduction along the cable, said inductively coupling connected between the cable reel and the downhole tool; and receiving said modulated data signals.

5. The method for data transmission according to claim 4 wherein said step of modulating data signals includes the step of:

modulating data signals on a second radio frequency carrier wave.

6. The method for data transmission according to claim 4 also including the steps of:

determining signal level;

shifting frequency on which said data signals are modulated whenever said signal level is lower than a predetermined maximum.

7. A data transmission system for use with a multiple conductor logging cable on a cable reel connecting a downhole tool to a logging truck comprising:

cable jacket around the multiple conductor logging cable;

means for producing data signals from the logging truck;

means for modulating said data signals on a radio frequency carrier wave;

second means for modulating said data signals on a second radio frequency carrier wave;

means for inductively coupling said modulated data signals to said cable jacket for conduction along the cable, said means for inductively coupling connected between the cable reel and the downhole tool;

means for determining signal level;

means for shifting frequency on which said data signals are modulated whenever said signal level is lower than a predetermined maximum; and means for receiving said modulated data signals.

* * * * *